United States Patent [19]

Kumar et al.

[11] Patent Number: 4,865,666

[45] Date of Patent: Sep. 12, 1989

[54] MULTICOMPONENT, LOW DENSITY CUBIC $L1_2$ ALUMINIDES

[75] Inventors: K. Sharvan Kumar, Baltimore; Walter Precht, Towson, both of Md.

[73] Assignee: Martin Marietta Corporation, Bethesda, Md.

[21] Appl. No.: 108,502

[22] Filed: Oct. 14, 1987

[51] Int. Cl.[4] ..... C22C 21/00

[52] U.S. Cl. ..... 148/437; 148/438

[58] Field of Search ..... 420/551, 529, 538, 552; 148/437, 438

[56] References Cited

U.S. PATENT DOCUMENTS 4,292,077 9/1981 Blackburn et al. ..... 75/175.5
4,294,615 10/1981 Blackburn et al. ..... 75/175.5

OTHER PUBLICATIONS

"Structural Uses For Ductile Ordered Alloys," A Report of the Committee on Application Potential for Ductile Ordered Alloys, National Materials Advisory Board, National Academy Press, Washington, DC, 1984.

"Phase Equilibria in The Copper-Titanium-Aluminum System," Piero Verdis & Ulrich Zwicker, Z. Metalkde, vol. 62 (1971), No. 1.

"Phase Equilibria in the Ternary Systems Ti-Fe-O and Ti-Al-Fe," Angelika Seibold, Z. Metalkde, 72 (10:712-719), 1981.

"Toward A Miscroscopic Basis For Mechanical Behavior," Philosophical Magazine Letters, 1987, vol. 55, No. 4, 157-161.

"High Temperature Ordered Intermetallic Alloys," C. C. Koch, C. T. Liu, N. S. Stoloff, eds; *Proceedings of the Materials Research Society Symposium,* Nov. 26-28, 1984; Boston; vol. 39, p. 265.

*Primary Examiner*—R. Dean

*Attorney, Agent, or Firm*—Herbert W. Mylius; Gay Chin

[57] ABSTRACT

Intermetallics capable of use as structural elements, exhibiting relatively high ductility and low brittleness, comprise ternary and quaternary $TiAl_3$ alloys of the general formulae Al—Ti—M and Al—Ti—M—M', wherein M is selected from Cu, Ni, and Fe, M' is selected from V, Nb, and Ta. Such materials exhibit cubic, $Ll_2$ crystal structures.

44 Claims, 5 Drawing Sheets

FIG. 2
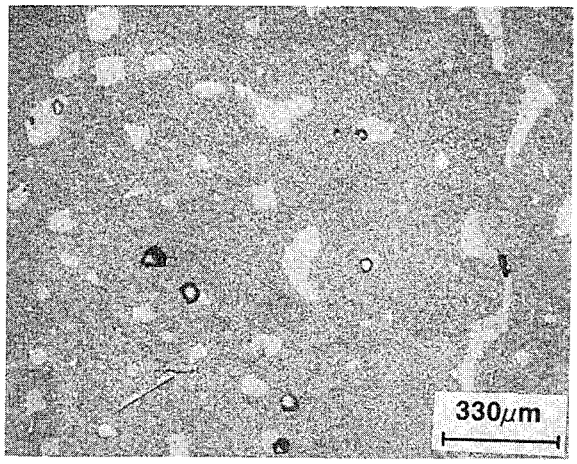
TWO PHASE MICROSTRUCTURE
OF PARTIALLY HOMOGENIZED DDF 4.
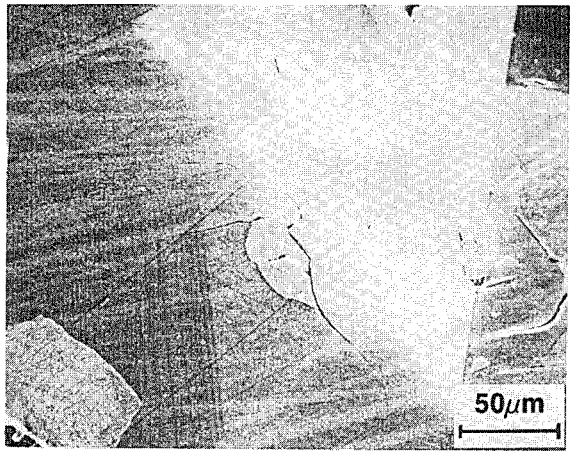
HARDNESS INDENTATION OF
PARTIALLY HOMOGENIZED DDF 4.
FIG. 3

FIG. 4
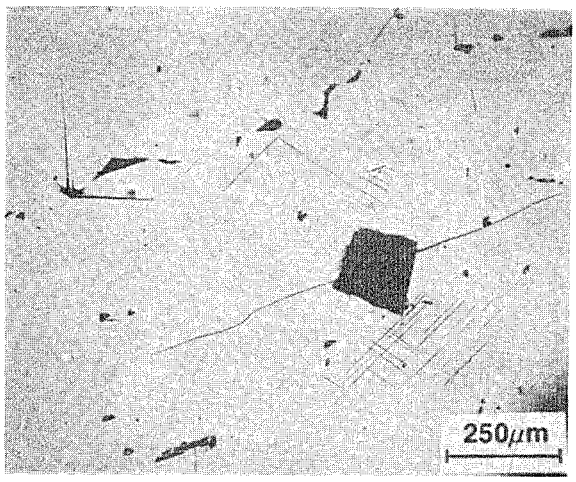
HARDNESS INDENTATION USING
A 1 kg LOAD ON AS-CAST DDF 10.
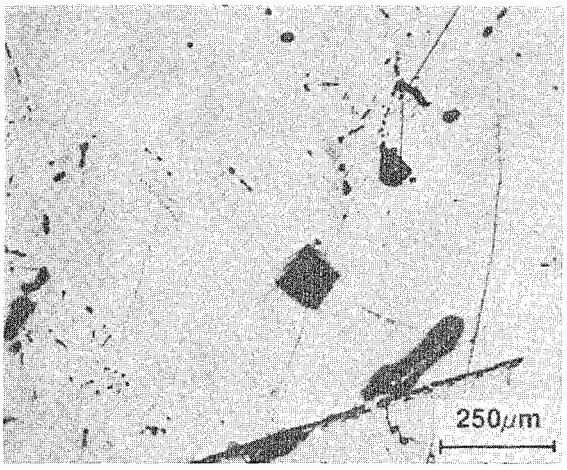
HARDNESS IDENTATION USING
A 1 kg LOAD ON HOMOGENIZED DDF 10.
FIG. 5

HARDNESS IDENTATION USING
A 20 kg LOAD ON HOMOGENIZED DDF 4.

MULTICOMPONENT, LOW DENSITY CUBIC $L1_2$ ALUMINIDES

BACKGROUND OF THE INVENTION

This invention relates to low-density, relatively ductile aluminides exhibiting a cubic $L1_2$ crystal structure. Specific exemplary aluminides include ternary Al-Ti-M systems (wherein M is Cu, Ni, Co, or Fe). Further, quaternary systems in which V, Nb, or Ta are added to the ternary elements of the Al-Ti-M system have also been found to exhibit a $Ll_2$ structure and desirable properties.

Aluminum rich intermetallic alloys such as $TiAl_3$ have long been known to have potential use as low-density elevated-temperature materials. For example, many ordered alloys retain high strength and high modulus at elevated temperatures. In addition, they tend to demonstrate higher oxidation resistance than conventional alloys. However, such alloys have been characterized by extreme brittleness. This brittleness, or low ductility at ambient temperatures, is objectionable for structural applications, and results from diverse reasons such as insufficient numbers of slip systems, limited cross slip, locking of dislocations by impurities, and weak intergranular bonding. Past work has circumvented these problems by using ordered alloys only as second phase particles added to strengthen a disordered matrix, as illustrated by various nickel-based superalloys.

As discussed herein, the term "ordered alloys" will refer to alloys having two or more atomic species which occupy specific sites in the crystal lattice. Ordered alloys have been extensively studied since the mid 1950s, with little success achieved in overcoming ambient temperature ductility deficiencies. Aluminides, based upon titanium, iron, and nickel, were identified as being among the more interesting systems in terms of structural properties. Due to inability to overcome basic problems of brittleness and lack of ductility, various alternative uses for such materials were developed, such as the use of nickel and cobalt aluminides for coating turbine hardware, or the use of iron-cobalt alloys in transformers in view of their high magnetic permeability. Ordered alloys such as $Ni_3Al$ and $Ni_3Nb$ were used as strengthening phases in steels. The potential for use of ordered alloys in structural applications increased with ductility improvements achieved in TiAl and $Ti_3Al$ based alloys produced through powder metallurgical and alloying techniques. Rapid solidification techniques led to renewed interest in iron and nickel aluminides. One example is known to have been published in the last decade, where hexagonal $Co_3V$ was transformed by alloying to the cubic $L1_2$ structure through control of electron-to-atom concentrations. However, this is the only system in which such a transformtion is known to have been successfully made. The drawback of this material is that it is based on a high density intermetallic, and no such attempts are known to have been made in the lighter weight aluminide systems. For a more extensive discussion, attention is directed to "STRUCTURAL USES FOR DUCTILE ORDERED ALLOYS," a report of the Committee on Application Potential for Ductile Ordered Alloys, National Materials Advisory Board, National Academy Press, Washington, DC, 1984.

In U.S. Pat. No. 4,292,077, Blackburn et al. disclosed titanium-aluminum-niobium alloys having a compositional range in which ductility at low temperature is achieved. This reference relates specifically to the addition of from eleven to sixteen atomic percent niobium to binary ordered alloys of the $Ti_3Al$ type. In this technique, it is not fully understood why the ductility improves, but it is known that the improvement is not the result of a change in the crystal structure. Such alloys may be stated in nominal weight percent as Ti—13/15 Al-19.5/3ONb. In one embodiment of the invention, vanadium partially displaces niobium, thereby lowering density, while favorable high temperature properties are retained.

In U.S. Pat. No. 4,294,615, Blackburn et al. teach alloys based upon TiAl gamma phase structure, to which binary structure up to four percent vanadium has been added. The TiAl gamma alloy system was selected as having the potential for being lighter, inasmuch as it has lower density due to the high concentration of aluminum. Blackburn et al. recognize the tetragonal arrangement of the atoms of TiAl, and the different alloying characteristics of such a system as compared to the hexagonal crystal structure of $Ti_3Al$. Patentees found that in titanium alloys comprising a rather narrow compositional range of aluminum, between 48–50 atomic percent, various elements could be added for altering properties beneficially. Alloys with lower aluminum concentration have higher strength but ductilities much less than 1.5 percent, while higher aluminum concentrations than the specified range gave lower strengths and lower ductilities. The addition of 0.1 to 4 percent by weight of vanadium improved room and moderate temperature ductility without adversely affecting high temperature strength. Both ternary and quaternary systems were investigated, with vanadium being the primary additive material. In the quaternary systems suggested by the Patentees, beta promoters such as molybdenum and tungsten, and alpha promoters such as bismuth and antimony, were evaluated. As discussed relative to the previous reference, none of the additives change the crystal structure of the parent intermetallic.

In the article, "PHASE EQUILIBRIA IN THE COPPER-TITANIUM-ALUMINUM SYSTEM," by Piero Verdis and Ulrich Zwicker, Z. Metalkde, Volume 62 (1971), No. 1, pp. 46–51, the existence of the $Ll_2$ phase $CuTi_2Al_5$ is noted. This paper was primarily concerned with phase identification and stability ranges, rather than the identification of useful structural materials. It is worth noting that in this work no attempt was made to prepare a single phase $T_3$ material and measure its mechanical properties.

Similarly, the article "PHASE EQUILIBRIA IN THE TERNARY SYSTEMS Ti-Fe-O AND Ti-Al-Fe," by Angelika Seibold, at Z. Metalkde, 72 (10:712–719), 1981, teaches the existence of a ternary $Ll_2$ phase corresponding to the approximate composition $Ti_8Al_{22}Fe_3$. Again, this reference is primarily directed to identification of various phases within the system, and does not touch upon the issue of properties for structural applications, nor teach the preparation of a single phase material corresponding to the composition.

It is important to emphasize at this juncture that the existence of a cubic $Ll_2$ phase does not guarantee ductility, as illustrated by the approximately equal split amongst ductile and brittle $Ll_2$ intermetallic compounds observed by Vvedensky and Eberhart ("TOWARD A MICROSCOPIC BASIS FOR MECHANICAL BEHAVIOR," *Philosophical Magazine Letters*, 1987, vol.

55, no. 4, 157–161). Moreover, it has been shown by C. T. Liu that $L1_2$ intermetallic compounds do not necessarily show advantageous high temperature properties (Liu, "HIGH TEMPERATURE ORDERED INTERMETALLIC ALLOYS," C. C. Koch, C. T. Liu, N. S. Stoloff, eds; *Proceedings of the Materials Research Society Symposium, Nov.* 26–28, 1984; Boston; vol. 39, p. 265). Accordingly, it would not be anticipated that the transformation from a tetragonal $DO_{22}$ $TiAl_3$ structure to a cubic $Ll_2$ structure would necessarily result in enhanced ambient temperature ductility, while retaining advantageous high temperature properties. Absent an indication of such properties, one would not be led to utilize such materials in structural components.

SUMMARY OF THE INVENTION

An object of the present invention is to provide aluminum-rich titanium aluminides having high strength to density ratios, which are useful at elevated temperatures, and which have ductility at lower temperatures sufficient to permit use as structural elements.

A further object of the present invention is to provide lightweight structural materials having high modulus and high melting point, without the high degree of brittleness normally encountered in the aluminum rich $TiAl_3$.

A still further object of this invention is to provide additives for $TiAl_3$ which result in significant improvements in ductility.

A still further object of this invention is to provide intermetallics having a greater number of available and active slip systems, thus improving ductility.

It is known that ordered intermetallics offer a number of unique properties that make them extremely attractive for structural use. Among these desirable properties are high modulus, especially at elevated temperature, high melting point, and high strain-hardening rates coupled with low self-diffusion rates, resulting in excellent creep resistance and a high recrystallization temperature. The major problem with most ordered intermetallics has been a tendency for inherent brittleness and low ductility, for a wide variety of reasons. For example, in the case of $Ni_3Al$, low ductility results from poor grain boundary cohesion. However, the addition of small quantities of boron to off-stoichiometric $Ni_3Al$ results in significant improvements in ductility. (See "STRUCTURAL USES FOR DUCTILE ORDERED ALLOYS," previously cited.) Other factors which contribute to poor ductility of ordered intermetallics include insufficient numbers of slip systems (primarily in noncubic alloys), limited cross slip, and impurity locking of dislocations. Conventional remedies for such problems include removal of impurities and second phase particles, alloying to stabilize specific second phases (e.g., Blackburn et al. re stabilization of beta phase in titanium aluminides), and grain refinement via thermomechanical and/or rapid solidification processing.

Of various types of ordered intermetallics investigated, the family of iron, nickel, and titanium aluminides has received most of the attention in the prior art. However, the present inventors noted that the development of a ductile aluminide with a lower density would significantly enhance areas of potential application. Thus, it is an object of the present invention to provide a ductile aluminide with a density less than that of elemental titanium, 4.5 grams per cubic centimeter. The family of titanium aluminides ($Ti_3Al$, TiAl, and $TiAl_3$), all exhibit densities less than 4.5 grams per cubic centimeter; however, these aluminides possess extremely low room temperature ductility. Of these titanium aluminides, $TiAl_3$ has the lowest density at about 3.3 grams per cubic centimeter, and has received the least attention, partially due to its tetragonal structure, resulting in poor ductility. In addition, being a line-compound on the phase diagrams, it offers very little compositional maneuverability. The present invention transforms the tetragonal $TiAl_3$ structure to a cubic form in order to enhance its ductility.

Ordered intermetallics at the aluminum-rich end would further alleviate density problems for structural materials; however, aluminides which are rich in aluminum are not of the $Ll_2$ cubic structure desired. The cubic $Ll_2$ crystal structure (such as exhibited by $Cu_3Au$) exhibits the highest degree of symmetry of all the possible structures for ordered alloys and therefore has the greatest number of available slip systems. It should be noted that while it is desirable, for plastic flow, to have the maximum number of available slip systems, such flow is only possible if the slip systems are actually active or operating. An increased number of slip systems could imply improved ductility should these slip systems be active, and previous investigations have shown that this is indeed the case. A few elements belonging to the rare-earth group form equilibrium $Ll_2$ cubic aluminides, and of these, the only one promising great potential is $ScAl_3$, with a density of 3.01 grams per cubic centimeter, and a melting point of 1320° C. The major drawback, however, is the exorbitant cost of scandium metal. At present, this cost factor precludes extensive large-scale experimentation as well as widespread applications.

Although earlier papers have confirmed the existence of aluminum-rich ternary intermetallics of the $Ll_2$ type, no attempt was previously made to produce a single-phase cubic $Ll_2$ intermetallic; rather, the phase was identified as part of a program to evaluate ternary phase diagrams. There is, to the inventors' knowledge, no published information on the processing and the property relationships of this family of intermetallics. It is believed that the present invention constitutes the first attempt to isolate and produce specimen quantities of this ternary cubic $Ll_2$ material with the purpose of evaluating its properties and potential as a structural material. Further, unique and heretofor unknown quaternary systems were investigated by the present inventors, and found to offer strong potential for use in structural materials. The specific cubic $Ll_2$ materials investigated included the ternary system Al-Ti-M, and the quaternary system Al-Ti-M-M', wherein M is a metal selected from Cu, Ni, Co, and Fe, and M' is selected from V, Nb, and Ta.

BRIEF DESCRIPTION OF THE DRAWINGS

FIG. 2 represents a photomicrograph illustrating the two phase microstructure of partially homogenized Al-Ti-Fe.

FIG. 3 is a photomicrograph of a hardness indentation of the partially homogenized Al-Ti-Fe.

FIG. 4 is a photomicrograph of a hardness indentation, using a 1 kilogram load, on as-cast $TiAl_3$.

FIG. 5 is a photomicrograph of a hardness indentation, using a 1 kilogram load, on homogenized $TiAl_3$.

PREFERRED EMBODIMENTS

Figure 1A:
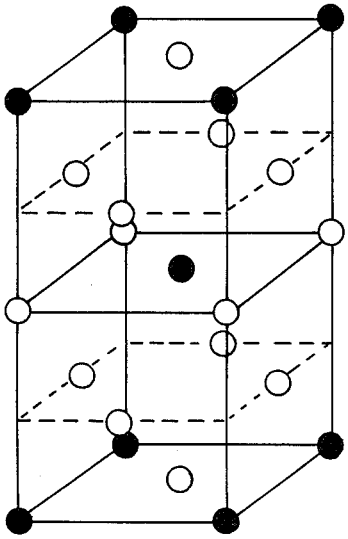
FIG. 1 illustrates two structures, FIG. 1*a* representing the $DO_{22}$ structure of unmodified $TiAl_3$, and FIG. 1*b* representing the $Ll_2$ structure of the ordered cubic intermetallic of the present invention.
Figure 1B:
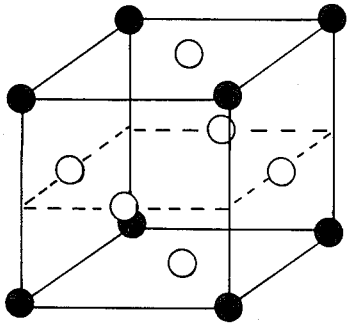

The preferred embodiments herein described are set forth in terms of atomic percent of elements. As previously indicated, the present invention relates to ternary and quaternary systems, based upon the ordered intermetallic $TiAl_3$. More specifically, the invention relates to the following alloy systems: Ti—Al—M, and Ti—Al—M—M', wherein M is selected from Cu, Ni, Co, and Fe, and M' is selected from V, Nb, and Ta. It is understood that within the concept of the present invention that alloys comprising isomorphic M members may be utilized in place of the ternary additive. As an example, copper and nickel exhibit total solid solubility, and therefore copper-nickel mixtures may be used in place of copper. Investigation of the various possible ranges of components of both the ternary and quaternary systems has led the inventors to believe that the following approximate ranges are to be preferred (ranges are recited in atomic percent):

| Ternary Aluminides |
|---|
| Al: 60–67 percent |
| Ti: 24–28 percent |
| M: 8–14 percent |
| **Quaternary Aluminides** |
| Al: 60–67 percent |
| Ti: 20–25 percent |
| M: 8–10 percent |
| M': 0.1–6 percent |

Alloys of the compositions outlined in Table I were cast in 25 to 50 gram quantities via induction melting. The as-cast microstructure was characterized by X-ray diffraction, optical and scanning electron microscopy, and hardness indentation. The alloys were extensively homogenized to get rid of the as-cast microstructure, and once again, characterized using the above mentioned techniques.

TABLE I

| | TARGET COMPOSITIONS | | | | | | |
|---|---|---|---|---|---|---|---|
| | Composition (Atomic Percent) | | | | | | |
| Alloy | Al | Ti | Fe | Cu | V | Nb | Other |
| DDF 10 | 75.00 | 25.00 | — | — | — | — | — |
| DDF 4 | 66.67 | 24.24 | 9.09 | — | — | — | — |
| DDF 9 | 64.00 | 26.00 | 10.00 | — | — | — | — |
| DDF 12 | 66.46 | 23.75 | 9.30 | — | 0.50 | — | — |
| DDF 14 | 66.86 | 22.09 | 9.01 | — | 2.05 | — | — |
| DDF 15 | 66.86 | 20.20 | 9.01 | — | 4.00 | — | — |
| DDF 16 | 66.86 | 22.09 | 9.01 | — | — | 2.04 | — |
| DDF 17 | 64.75 | 21.25 | 9.00 | — | — | 5.00 | — |
| DDF 19 | 65.00 | 24.00 | 9.00 | — | — | — | 2.00 Ta |
| DDF 1 | 62.50 | 25.00 | — | 12.50 | — | — | — |
| DDF 3 | 63.00 | 24.50 | — | 12.50 | — | — | — |
| DDF 6 | 63.00 | 27.00 | — | 10.00 | — | — | — |
| DDF 8 | 63.00 | 28.00 | — | 9.00 | — | — | — |
| DDF 2 | 60.00 | 26.00 | — | 7.00 | — | — | 7.00 Ni |
| DDF 18 | 66.67 | 24.24 | — | — | — | — | 9.09 Co |

Commercially available powders of the appropriate elements were blended according to the compositions set forth in Table I and cold isostatically compacted into cylinders weighing approximately 25 grams. The rods were then placed in an alumina crucible and induction heated under vacuum. The samples in the crucible went through an exothermic reaction which propagated from the bottom of the cylindrical rod upwards. Following the completion of the reaction, power was turned off and the system allowed to cool under helium. The reacted rods were then transferred to another alumina crucible and the system evacuated and then backfilled with helium. Melting and subsequent cooling of the material were carried out in flowing helium. The ingots thus obtained were removed from the crucible and characterized.

The as-cast structure was characterized using X-ray diffraction and optical microscopy. In the case of DDF 4 and DDF 9, a two-phase microstructure consisting of an $Ll_2$ cubic matrix phase and a significant amount of an interdendritic second phase were observed. DDF 10, the unalloyed $TiAl_3$ composition, was also found to have low volume fraction of an acicular shaped second phase. The DDF 4 composition ingot was then homogenized by holding the alloy at a temperature of about 1150° C. for two days in flowing argon. Subsequent microstructural analysis showed a decrease in the volume fraction of the interdendritic phase, and also a change in morphology of the second phase from an interconnected type to a discrete globular type, see FIG. 2. Hardness indentation, using Vicker's hardness testing techniques, showed the second phase to be relatively brittle (FIG. 3) compared to the matrix material, serving as a preferential crack propagation medium, which is thus detrimental. The second phase was eliminated by homogenizing DDF 4 for a period of five days at 1200° C. This treatment was found sufficient for dissolving all of the globular second phase, and leaving behind an essentially single phase material. Composition DDF 9, on the other hand, still contained second phase particles after a similar homogenization treatment.

Figure 6:
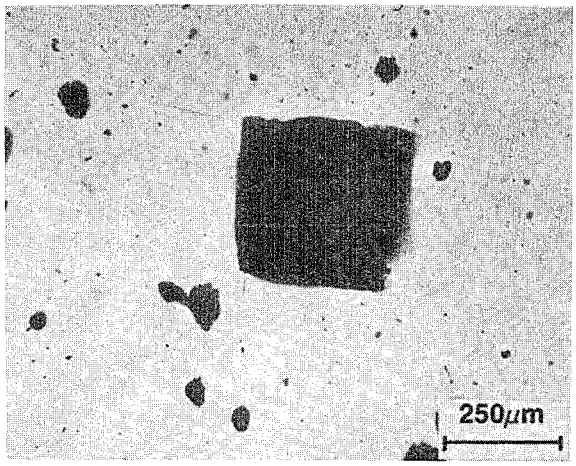
FIG. 6 represents a photomicrograph of a hardness indentation, using a 20 kilogram load, on homogenized Al—Ti—Fe.

The DDF 10 composition corresponds to a pure $TiAl_3$ composition, and serves as the base line material to which the new invention can be compared. Vicker's hardness indentation was used to assess the resistance to cracking under various loads, as a measurement of ductility. In the context of the present invention, ductility is understood to imply reduced brittleness as measured by decreased cracking under hardness indentation loading. The as-cast DDF 10 alloy, which has a $DO_{22}$ tetragonal structure, shows significant cracking under as little as 1 kilogram load, FIG. 4. Following homogenization at 1200° C. for five days, the DDF 10 alloy still cracked under a 1 kilogram load, although less severely than in the as-cast condition, FIG. 5. In comparison, DDF 4, a single phase cubic $Ll_2$ material in the fully homogenized condition, shows minimal cracking even at a load of 20 kilograms, FIG. 6, and extensive slip traces may be seen, an indication of plastic deformation. This represents a significant reduction in brittleness.

DDF 9, which contained second phase particles after homogenization, was found to exhibit an intermediate behavior in terms of resistance to cracking, when compared to DDF 4 and DDF 10. DDF 12 and DDF 14 are quaternary cubic aluminides containing vanadium in addition to aluminum, titanium, and iron. The microstructures of these alloys in the as-cast condition were similar to those of as-cast alloys DDF 4 and DDF 9. Vicker's hardness indentation, using a 60 kilogram load on the as-cast DDF 12, reveals excellent resistance to cracking, an improvement above and beyond that achieved by the aforementioned ternary system.

It was found possible to enhance the ductility of the ternary Al—Ti—Fe aluminide when vanadium was used to substitute partially for titanium. The DDF 12 and DDF 14 alloys contained 0.5 atomic percent and 2.05 atomic percent vanadium, respectively. Vanadium has an atomic radius of 1.92 angstrom, as compared to titanium which has an atomic radius of 2.00 angstrom. Two additional compositions, DDF 15, corresponding to the Al—Ti—Fe—V quaternary containing 4.0 atomic percent vanadium, and DDF 16, corresponding to the quaternary Al—Ti—Fe—Nb, containing 2.04 atomic percent niobium, were then prepared and tested. Niobium was added to partially substitute for titanium with a larger atom, since niobium has an atomic radius of 2.8 angstroms and differs from titanium to the same extent as does vanadium, with niobium being larger rather than smaller. These two alloys were produced by the same techniques as previously pointed out and similarly characterized.

Figure 7:
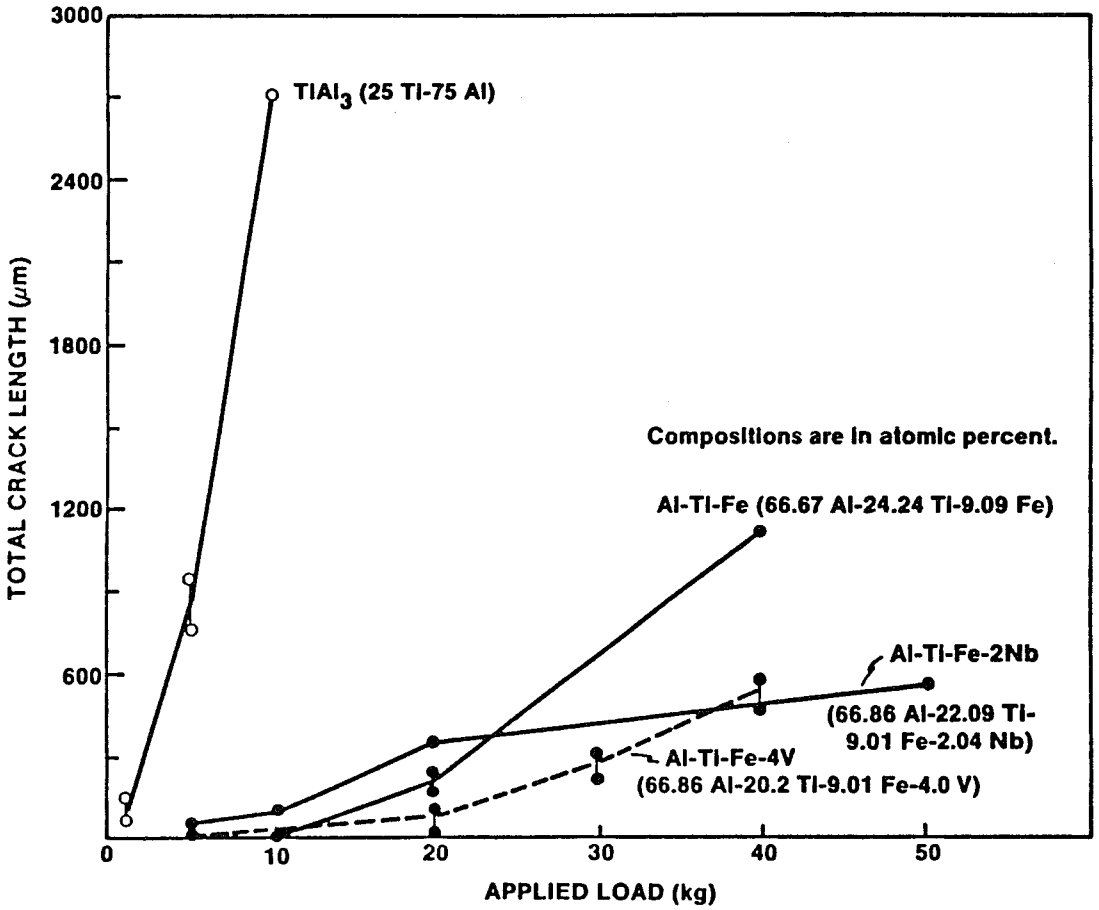
FIG. 7 represents a graph of total crack length as a function of applied indentation load for various $TiAl_3$ materials.

The ability of the alloys set forth in Table I to resist cracking under various indentation loads was used as a measure to grade them, and this information is set forth graphically in FIG. 7. Specifically, the total crack length obtained for various applied indentation loads was measured for each alloy. The ideal material would lie along the abscissa, i.e. with no cracks being present irrespective of the applied load. FIG. 7 clearly shows that the cubic intermetallics, ternary and quaternary, are superior to the binary $TiAl_3$, and further, that the cubic quaternary Al—Ti—Fe—Y and Al—Ti—Fe—Nb aluminides are superior to the cubic ternary Al—Ti—Fe intermetallic. These results for the quaternary materials, relative to the ternary materials represent valuable and significant improvements. However, the mechanism by which the benefit is obtained is not fully understood. Clearly, it is not solely an effect of atomic radius ratio, but may involve changes in the electronic band structure of the solid, and hence in the nature of the atomic bonding in the structure.

Materials of both the ternary and quaternary systems described above are capable of being processed by conventional metal-working techniques to yield various shaped articles of manufacture and structural elements.

It is to be understood that the above description of the present invention is susceptible to various modifications, changes, and adaptations by those skilled in the art, and that the same are to be considered to be within the scope of the present invention, which is set forth by the appended claims.

We claim:

1. A composition of matter consisting essentially of a single phase cubic $Ll_2$ crystal structure intermetallic alloy of the formula Al—Ti—M, wherein M is selected from Cu, Co, Ni, and Fe, and wherein Al constitutes from about 60 to about 67 atomic percent, Ti constitutes from about 24 to about 28 atomic percent, and M constitutes from about 8 to about 14 percent.

2. A composition as set forth in claim 1, wherein M is iron.

3. A composition as set forth in claim 1, wherein M is copper.

4. A composition as set forth in claim 1, wherein M is nickel.

5. A composition as set forth in claim 1, wherein M is cobalt.

6. A structural element comprising an intermetallic compound having a substantially single phase cubic $Ll_2$ crystal structure, of the formula Al-Ti-M wherein M is selected from Cu, Co, Ni and Fe, and Al, Ti, and M are present, in atomic percentages, in the ranges 60–67 percent, 24–28 percent, and 8–14 percent, respectively.

7. A structural element as set forth in claim 6, wherein M is iron.

8. A structural element as set forth in claim 6, wherein M is copper.

9. A structural element as set forth in claim 6, wherein M is nickel.

10. A structural element as set forth in claim 6, wherein M is cobalt.

11. A composition of matter consisting essentially of a single phase cubic $Ll_2$ crystal structure intermetallic alloy of the formula Al—Ti—M—M′, wherein M is selected from Cu, Co, Ni, and Fe, M′ is selected from V, Nb, and Ta, and Al, Ti, M, and M′ are present, in atomic percent, in the ranges of from about 60 to about 67 percent, from about 20 to about 25 percent, from about 8 to about 10 percent, and from 0.1 to about 6 percent, respectively.

12. A composition as set forth in claim 11, wherein M is Cu.

13. A composition as set forth in claim 12, wherein M′ is V.

14. A composition as set forth in claim 12, wherein M′ is Nb.

15. A composition as set forth in claim 12, wherein M′ is Ta.

16. A composition as set forth in claim 11, wherein M is Co.

17. A composition as set forth in claim 16, wherein M′ is V.

18. A composition as set forth in claim 16, wherein M′ is Nb.

19. A composition as set forth in claim 16, wherein M′ is Ta.

20. A composition as set forth in claim 11 wherein M is Ni.

21. A composition as set forth in claim 20 wherein M′ is V.

22. A composition as set forth in claim 20 wherein M′ is Nb.

23. A composition as set forth in claim 20 wherein M′ is Ta.

24. A composition as set forth in claim 11 wherein M is Fe.

25. A composition as set forth in claim 24 wherein M′ is V.

26. A composition as set forth in claim 24 wherein M′ is Nb.

27. A composition as set forth in claim 24 wherein M′ is Ta.

28. A structural element comprising an intermetallic compound having a substantially single phase cubic crystal structure, of the formula Al—Ti—M—M′ wherein M is selected from Cu, Co, Ni, and Fe, and M′ is selected from V, Nb, and Ta, and Al, Ti, M, and M′ are present, in atomic percentages, in the ranges 60–67 percent, 20–25 percent, 8–10 percent, and 0.1–6 percent, respectively.

29. A structural element as set forth in claim 28, wherein M is Cu.

30. A structural element as set forth in claim 29, wherein M′ is V.

31. A structural element as set forth in claim 29, wherein M′ is Nb.

32. A structural element as set forth in claim 29, wherein M′ is Ta.

33. A structural element as set forth in claim 28, wherein M is Co.

34. A structural element as set forth in claim 33, wherein M′ is V.

35. A structural element as set forth in claim 33, wherein M′ is Nb.

36. A structural element as set forth in claim 33, wherein M′ is Ta.

37. A structural element as set forth in claim 33, wherein M is Ni.

38. A structural element as set forth in claim 37, wherein M′ is V.

39. A structural element as set forth in claim 37, wherein M′ is Nb.

40. A structural element as set forth in claim 37, wherein M′ is Ta.

41. A structural element as set forth in claim 28, wherein M is Fe.

42. A structural element as set forth in claim 41, wherein M′ is V.

43. A structural element as set forth in claim 41, wherein M′ is Nb.

44. A structural element as set forth in claim 41, wherein M′ is Ta.

* * * * *